United States Patent [19]

Clark et al.

[11] Patent Number: 4,944,423

[45] Date of Patent: Jul. 31, 1990

[54] CRACKER AND CONDIMENT BOWL

[76] Inventors: Mary J. Clark, R.D. 3 Box 114, Claysville, Pa. 15323; Paul M. Hankison, 106 Oakwood Rd., McMurray, Pa. 15317

[21] Appl. No.: 445,370

[22] Filed: Dec. 4, 1989

[51] Int. Cl.[5] ..... A47J 43/00

[52] U.S. Cl. ..... 220/20; 220/85 R; 220/83; 206/238; 206/239

[58] Field of Search ..... 220/20, 83, 85 R, DIG. 10, 220/277, 278, 287; 206/222, 228, 238, 239

[56] References Cited

U.S. PATENT DOCUMENTS

| | | | |
|---|---|---|---|
| 2,435,454 | 2/1978 | Maldonado | 206/239 |
| 2,806,393 | 9/1957 | Vickers | 220/85 |
| 3,165,249 | 1/1965 | Peck | 206/238 X |
| 4,116,355 | 9/1978 | Munn et al. | 220/83 |

*Primary Examiner*—Steven M. Pollard

[57] ABSTRACT

A cracker and condiment bowl having an annular outer space for storing packets of crackers and condiments in an upright position. The bowl has an inner cylindrical space for storing a disposable cup, introduced by pushing against flexible fingers covering the cylindrical space. An important feature is the provision of tapered slots, each having a razor blade, in the top of the bowl outer rim to facilitate cutting open of packets.

10 Claims, 2 Drawing Sheets

CRACKER AND CONDIMENT BOWL

This invention relates to a bowl of crackers, condiments, and the like, for use on a dining table.

BACKGROUND OF THE INVENTION

Items, such as empty containers or packets for crackers, sugar condiments, and the like, tend to clutter the table after disposal of the contents, making the table unattractive. Moreover, such containers or packets are often very difficult to tear open and often result, after forcible opening, in smearing of the fingers with ketchup, mustard or other condiments.

SUMMARY OF THE INVENTION

An object of the present invention is to overcome the above-named disadvantages by providing a novel bowl construction for tables. More specifically, the invention comprises a bowl having an outer annular container for storing packets of crackers, condiments and the like, and an inner container for storing a concealed disposible cup into which empty packets are placed through flexible fingers forming a cover.

DESCRIPTION OF THE PREFERRED EMBODIMENTS

Figure 1:
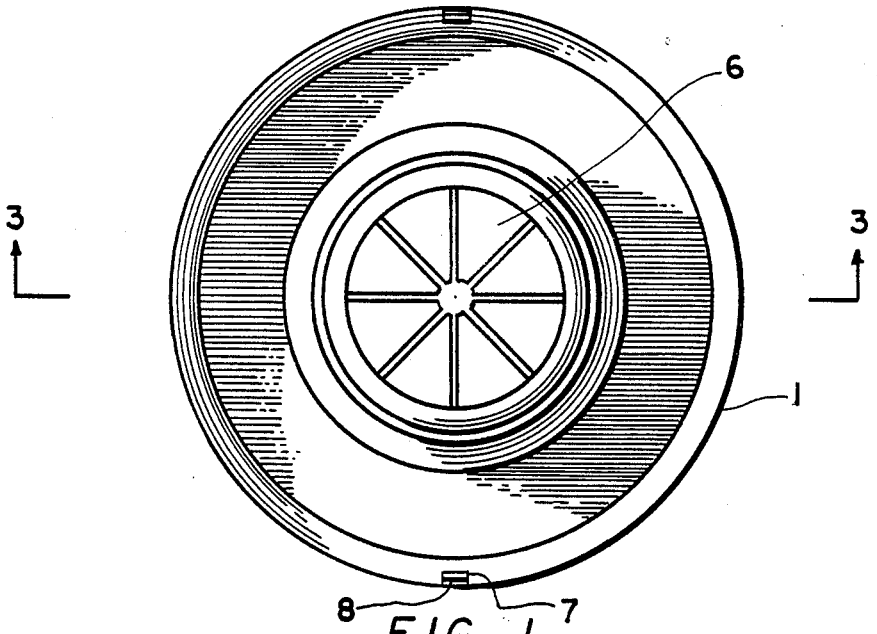
FIG. 1 is a top view of a cracker and condiment bowl embodying the present invention.
Figure 2:
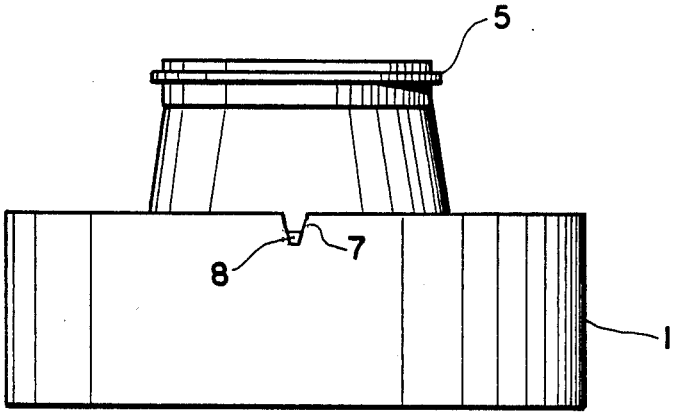
FIG. 2 is an elevational view thereof.
Figure 3:
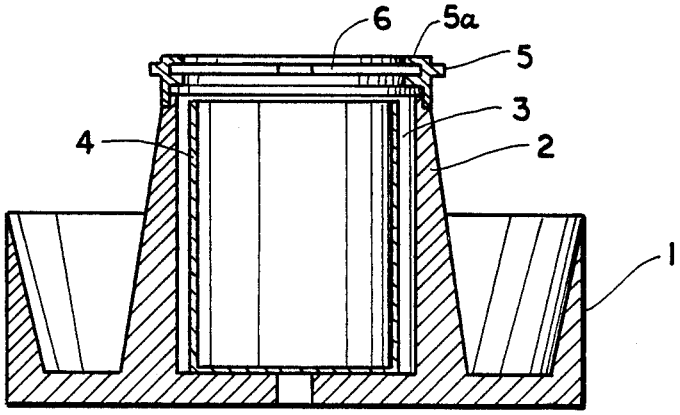
FIG. 3 is a vertical cross-sectional view taken along line 3—3 of FIG. 1.

Referring to FIGS. 1, 2 and 3, numeral 1 denotes an outer tapered wall and numeral 2 denotes an inner tapered circular wall forming an annular space in which cracker and condiment packets are stored in an upright position. A cylindrical space 3 is provided by wall 2 in which a disposible cup 4, such as of plastic material, is placed for receiving emptied packets for crackers or condiments. Such emptied packets are introduced into the disposible cup 4 by pushing downwardly against flexible, pie shaped fingers 6, the periphery of which is an integral ring enclosed in a slot 5*a* formed in an annular cover portion 5 seated on a top shoulder portion of wall 2 so that the cover portion 5 and fingers 6 form a cover or top of space 3 of wall 2.

The fingers 6 are of flexible material, such as rubber or thin plastic material so arranged that as one pushes down an empty packet or the like against the top center of the fingers 6, they will deflect downwardly to allow the empty packets to be deposited in cup 4, and as one's fingers are raised, the packet will be emptied into container 4 by the assistance of fingers 6 rubbing against one's fingers as they are automatically raised by the flexibility of fingers 6.

An important feature of the present invention resides in the formation of one or more tapered slots 7 about the top rim of outer wall 1. Embedded in the outer wall 1 at the bottom portion of slots 7 are razor blade pieces 8, one in each slot. The top opening of slot 7 must be sufficiently small as not to allow one's fingers to fit into a slot, say no more than about ¼inch, for safety purposes. Any number of slots having razor blade pieces 8, may be used, numbering from 1 to about 8, as desired.

In operation, a filled packet top marginal portion is inserted in slot 7 by having the fingers of one hand grasp one part of the portion as they extend in the annular space defined by walls 1 and 2, and the fingers of the other hand grasp the other part of the packet top portion while outside wall 1, whereupon the packet top marginal portion will be cut open upon contacting a razor blade piece 8, without smearing the fingers of the person with the contents of the packet.

Figure 4:
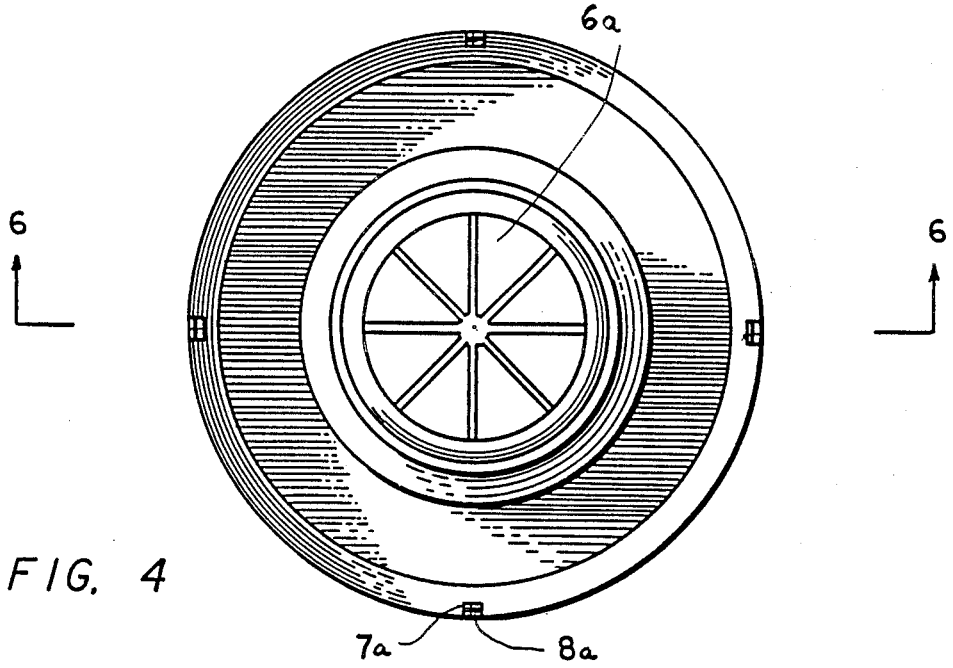
FIG. 4 is a top view of a modification of the bowl shown in FIGS. 1–3.
Figure 5:
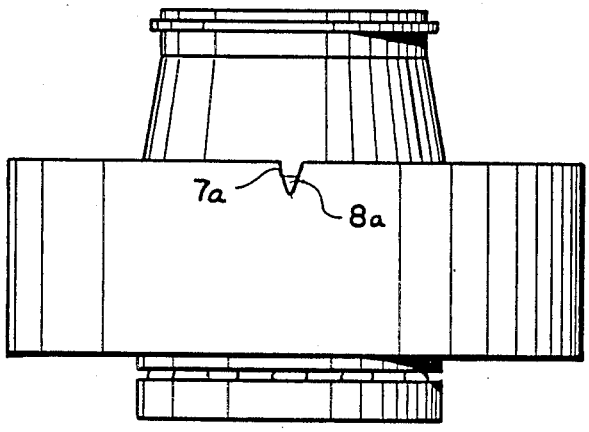
FIG. 5 is an elevational view thereof.
Figure 6:
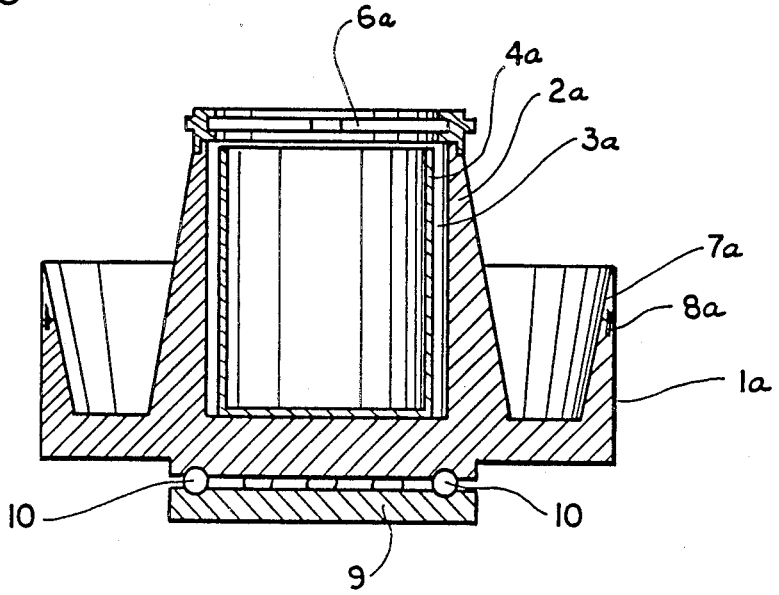
FIG. 6 is a vertical cross-sectional view taken along line 6—6 of FIG. 4.

FIGS. 4, 5 and 6 show a modification similar in construction to that shown in FIGS. 1–3, namely having outer wall 1*a*, inner wall 2*a*, space 3*a*, cup 4*a*, annular cover portion 5*a*, fingers 6*a* tapered slot 7*a* and razor blade piece 8a. In addition, a turn-table base 9 is provided, on which is supported, ball bearings 10 seated in correspondingly shaped portions of the base 9 and bottom of the bowl along circular paths.

A modification of slot 7*a* is provided in the form of a V shape with a razor blade piece 8*a* or, if desired, a turntable base, such as 9 shown in FIG. 6, may be used also in addition to the structure shown in FIGS. 1–3. Again, the top of slot 7*a* should not be in excess of about ¼ inch for safety purposes. Any number of slots 7*a*, from 1 to about 8, may be used, as desired.

Thus it will be seen that I have provided a novel and highly useful cracker and condiment bowl, for use on a dining table, that conveniently stores packets in an upright position, and which greatly facilitates opening of the packets by projecting the top edge of the packet into one of the tapered slots, such as 7 or 7*a*, until it is cut open by the razor blade.

While I have illustrated and described several embodiments of my invention, it will be understood that these are by way of illustration only and that various changes and modifications are contemplated in my invention within the scope of the following claims.

I claim:

1. A bowl for packets of crackers and condiments, said bowl having an outer rim on the top of which at least one slot is provided having a razor blade piece embedded in the bottom of the slot for facilitating opening of said packets.

2. A bowl as recited in claim 1 wherein said slot is tapered downwardly and inwardly.

3. A bowl as recited in claim 2 together with a cylindrical container portion centrally of said bowl for storing a disposable container, and a cover for said cylindrical container portion having a plurality of flexible, radially inwardly tapered finger portions which are flexed upon inserting empty packets therethrough for assisting removal of emptied packets from one's fingers upon withrawing them from the inside of said container portion.

4. A bowl as recited in claim 3 wherein said slot is less than about ¼ inch at the top.

5. A bowl as recited in claim 4 wherein a plurality of slots are provided, each having a razor blade piece at the bottom.

6. A bowl as recited in claim 4 together with a turntable supporting said bowl.

7. A bowl as recited in claim 3 wherein said finger portions are of rubber and substantially pie shaped.

8. A bowl as recited in claim 3 wherein said tapered finger portions are of thin, plastic material.

9. A bowl as recited in claim 3 wherein said cylindrical container portion is surrounded by an annular wall portion for storing packets in an upright position.

10. A bowl as recited in claim 3 wherein said tapered finger portions are of rubber.

* * * * *